US009341044B2

(12) United States Patent
Lehr et al.

(10) Patent No.: US 9,341,044 B2
(45) Date of Patent: May 17, 2016

(54) SELF-ENERGIZED SEAL OR CENTRALIZER AND ASSOCIATED SETTING AND RETRACTION MECHANISM

(71) Applicant: Baker Hughes Incorporated, Houston, TX (US)

(72) Inventors: Joerg Lehr, Celle (DE); Ines Rex, Lehrte-Arpke (DE); Keven O'Connor, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 608 days.

(21) Appl. No.: 13/675,681

(22) Filed: Nov. 13, 2012

(65) Prior Publication Data

US 2014/0131953 A1 May 15, 2014

(51) Int. Cl.
*E21B 23/06* (2006.01)
*E21B 33/126* (2006.01)
*E21B 17/10* (2006.01)

(52) U.S. Cl.
CPC ..... *E21B 33/126* (2013.01); *E21B 17/1014* (2013.01)

(58) Field of Classification Search
CPC ..... E21B 33/126; E21B 17/1028; E21B 17/1042; E21B 17/12; E21B 17/1014; E21B 17/1021
See application file for complete search history.

(56) References Cited

U.S. PATENT DOCUMENTS 2,605,846 A * 8/1952 Van Brunt et al. ..... 166/123
2,969,839 A * 1/1961 Greene ..... 166/63
3,119,451 A * 1/1964 Hall ..... 166/202
3,385,368 A * 5/1968 Solum et al. ..... 277/335
3,623,550 A * 11/1971 de Lajarte et al. ..... 166/125
4,423,783 A * 1/1984 Haag ..... 166/382
4,424,865 A 1/1984 Payton, Jr.
4,576,042 A * 3/1986 Johnson ..... 73/152.36
6,725,939 B2 4/2004 Richard
7,264,047 B2 * 9/2007 Brezinski et al. ..... 166/202
7,357,177 B2 4/2008 Garwood et al.
RE41,118 E 2/2010 Brezinski et al.
7,661,471 B2 2/2010 Murray et al.
7,703,512 B2 4/2010 Xu et al.
8,037,942 B2 10/2011 Vinson et al.
2003/0098153 A1 5/2003 Serafin
2008/0251250 A1 10/2008 Brezinski et al.
2009/0190602 A1 7/2009 Sung et al.
2010/0243237 A1 9/2010 Storey et al.
2011/0232900 A1 9/2011 Ring et al.
2012/0037355 A1 2/2012 Bishop et al.
2012/0061097 A1 3/2012 O'Connor et al.
2012/0085549 A1 4/2012 O'Connor et al.
2012/0217004 A1 8/2012 Yee et al.

* cited by examiner

*Primary Examiner* — John Kreck
(74) *Attorney, Agent, or Firm* — Steve Rosenblatt

(57) ABSTRACT

A self energizing structure can function as a centralizer or as a seal when allowed to spring out after a retainer is moved away from an overlying position for run in to protect the structure. Segments extend from a common base ring and are radially offset during run in. Alternating segments have landing surfaces on opposed ends such that on release of the structure the intervening segments land on such surfaces to form a cohesive single layer with all segments circumferentially aligned and against a surrounding tubular or the borehole wall. The structure is held retracted with a bi-directionally movable sleeve operable in a variety of ways from the surface. Internally the sleeve has splines to push the segments with the landing surfaces back so that the structure can collapse back into the sleeve for removal. Structures can be stacked and used as centralizers with alternating segments removed.

20 Claims, 7 Drawing Sheets

SELF-ENERGIZED SEAL OR CENTRALIZER AND ASSOCIATED SETTING AND RETRACTION MECHANISM

FIELD OF THE INVENTION

The field of the invention is sealing and/or centralizing devices that can be deployed of a tubular string at a subterranean location and more particularly structures that are self energized and held retracted for release at a desired location and subsequent retraction for removal from the subterranean location.

BACKGROUND OF THE INVENTION

Cup seals are called that because of their shape. They are closed at an end where they are mounted to a mandrel and open on an opposite end so that pressure applied in one direction pushes the edge of the cup outwardly to enhance the seal. The closed end can be backed up with rings that have the same cup shape which provide structural support against differential pressure on the inside of the cup and behind the lip of the cup that is against a surrounding tubular. The cup wall can be reinforced with internal ribs. Other mechanisms apart from the self energized feature of the cup shape generally rubber can be used to enhance the seal other than applied differential pressure in the cup and one such technique is to energize the ribs with external power sources. Some examples of one or more of these features are US Publication 2003/0098153 FIGS. 1 and 2; U.S. Pat. No. 7,357,177 noting the scalloped interior of the inside wall in FIGS. 4A and 4B; U.S. Pat. No. 4,424,865 using shape memory ribs in a geothermal application to enhance a seal; U.S. Pat. No. 7,703,512 using a rubber backup ring to push a rib into a packer cup wall; US Publication 2003/0098153 illustrating a composite wall structure for a packer cup; US Publication 2010/0243237 showing use of pairs of packer cups to isolate a zone to create relative movement between components and US Publication 2012/0217004 illustrates a multilayered ring with overlapping elements that are radially extended from expansion of an underlying mandrel to enhance the seal of a surrounding swelling packer element.

USRE 41,118 FIGS. 28 and 29 shows a petal design in multiple rows where the petals are circumferentially offset and retained with a band 314 for run in. Pipe 312 is expanded to break the band 314 and allow the petal rows to radially move toward the borehole wall as shown in FIG. 29.

The seal and centralizer of the present invention can have application in expansion methods where the seal is not itself expanded as shown in US Publication 2012/0061097 or US Publication 2012/0085549.

U.S. Pat. No. 6,725,939 illustrates a centralizer that can be expanded. US Publication 2008/0190602 illustrates another centralizer design.

The present invention is envisioned in a seal or centralizer configuration. It features a self-energized construction that is retained for run in to have a small dimension and released at a desired subterranean location. This can happen in a variety of ways one of which is axially shifting a sleeve that overlays the structure to adjacent the structure by a variety of motive sources. In the shifted position the retainer can back up the structure. The structure is preferably in multiple rows when retracted and then when allowed to expand reconfigures to a single row with edge ledges used to align adjacent segments as all the segments move outwardly to reach a surrounding borehole wall. The edge ledges are on alternate segments so that in between another segment rests on the ledges on opposed sides. Such structures can be stacked with each assembly in the stack as described above. The stacks can also be spaced to isolate zones or they can function as backup to each other against flow in a single direction while permitting flow in an opposite direction. The extended position can also be changed to a retracted position for removal of the seal or centralizer structure by shifting a sleeve that released the structure in an opposite direction where the sleeve has internal splines that push in the segments with end ledges first so that the single row of segments can then revert to multiple rows as the sleeve progresses to a position where the segments are substantially overlaid. The structure can function as a centralizer that permits flow therethrough by leaving out alternate segments in which case the internal splines in the sleeve can be eliminated. These and other features of the present invention will be more readily apparent to one skilled in the art from a review of the description of the preferred embodiments and the associated drawings while recognizing that the full scope of the invention is to be found in the appended claims.

SUMMARY OF THE INVENTION

A self energizing structure can function as a centralizer or as a seal when allowed to spring out after a retainer is moved away from an overlying position for run in to protect the structure. Segments extend from a common base ring and are radially offset during run in. Alternating segments have landing surfaces on opposed ends such that on release of the structure the intervening segments land on such surfaces to form a cohesive single layer with all segments circumferentially aligned and against a surrounding tubular or the borehole wall. The structure is held retracted with a bi-directionally movable sleeve operable in a variety of ways from the surface. Internally the sleeve has splines to push the segments with the landing surfaces back so that the structure can collapse back into the sleeve for removal. Structures can be stacked and used as centralizers with alternating segments removed.

DETAILED DESCRIPTION OF THE PREFERRED EMBODIMENT

Figure 1:
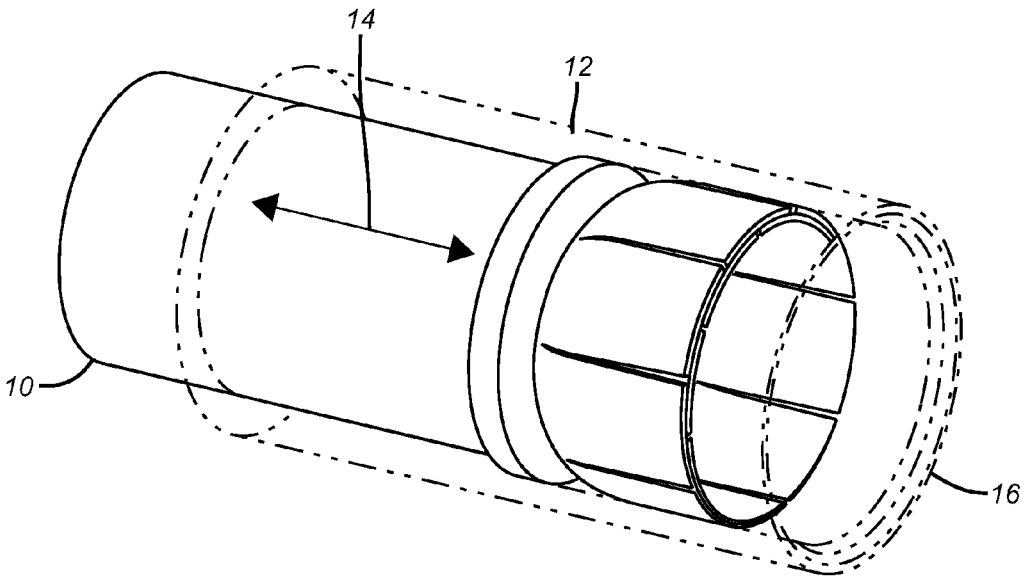
FIG. 1 shows the run in position with an overlying sleeve.
Figure 2:
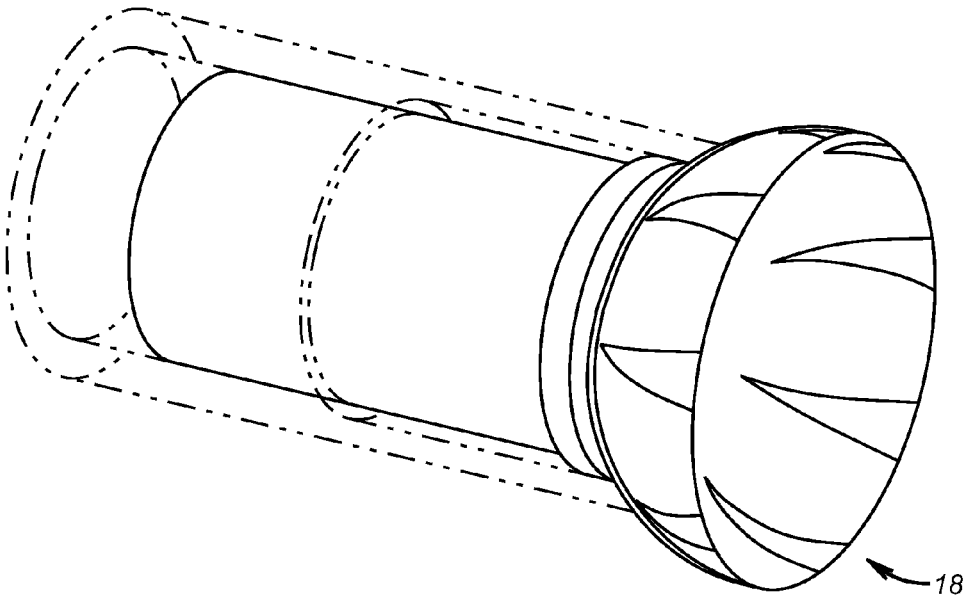
FIG. 2 is the view of FIG. 1 with the sleeve retracted so that the seal is actuated.

FIG. 1 illustrates a mandrel 10 that is generally a portion of a tubular string. Externally mounted sleeve 12 is axially shiftable with or without rotation on its axis as indicated by arrow 14. The leading end 16 of the sleeve 12 extends in FIG. 1 beyond the seal assembly 18. Arrow 14 is intended to schematically represent a variety of actuation systems that can translate the sleeve 12 between end positions where the seal 18 is held retracted as in FIG. 1 and is moved away from the seal 18 as in FIG. 2. Some actuation system examples are hydraulic piston actuation to bi-directionally drive the sleeve 12. A local power supply can drive a motor with a rack and pinion drive while being responsive to operate from a surface signal such as pressure pulses or acoustic signals that communicate to a local processor to trigger the desired motor operation. Another way is to use a hydraulically responsive j-slot mechanism responsive to annulus pressure cycles or alternatively a telescoping portion of the string that works with a j-slot and picking up and setting down weight to get the desired sleeve 12 movement. Other driving systems are also contemplated and the focus of the invention is on the presence of the sleeve and the resulting movement rather than the manner in which such movement is obtained.

Figure 5:
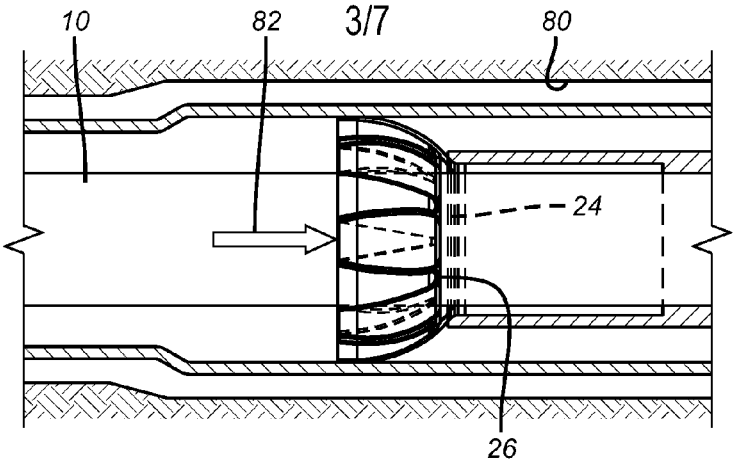
FIG. 5 illustrates the use of the seal to advance a tubular into a borehole with pressure from above.
Figure 6:
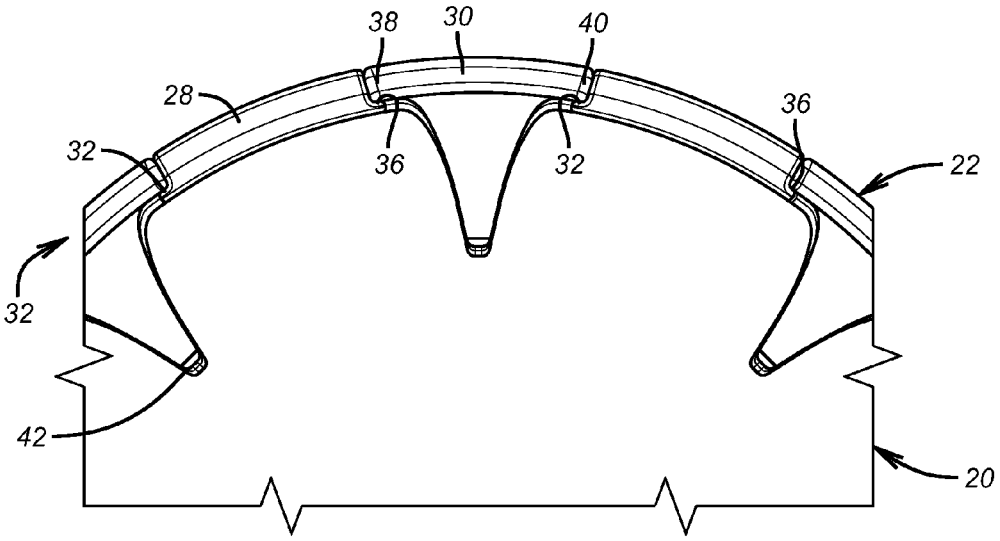
FIG. 6 is an end view of a seal configuration showing the end ledges on alternating members and intervening members on the ledges in the deployed position.
Figure 7:
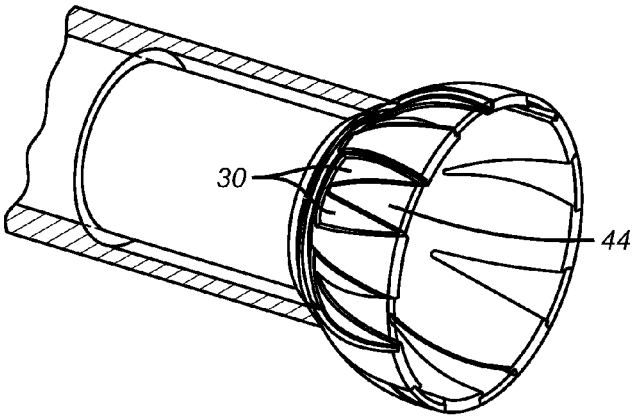
FIG. 7 shows the exterior sleeve retracted from the seal allowing the seal to actuate.

The nature of the seal assembly is best understood using FIGS. 1, 6 and 7. There are in the preferred embodiment two nested hemispherical cup shapes 20 and 22. Each shape has a central opening 24 so that the mandrel 10 can pass through. As best seen in FIGS. 5-7 the cup shapes 20 and 22 have extending segments 28 and 30 respectively that in the extended position of FIG. 4 define a single circumferential ring shape 32 because on spreading out after retraction of the sleeve 12 segments 28 and 30 nest circumferentially. Segments 28 and 30 are in an alternating pattern and in the extended position of FIG. 4 the segments 28 have radially extending edge ledge surfaces 32 and 36 on which rest edges 38 and 40 of the alternating segments 30. As the sleeve 12 is retracted the self energized feature of the segments 28 and 30 allows gaps 42 to open up between segments 28. The segments 30 a shaped to drop into the gap as the gap 42 opens to accept a given segment 30. As the gaps 42 close to retract the seal assembly 18 the segments 28 are pushed in radially by the sleeve 12 so that the segments 30 overly the segments 28. The segments 30 also have gaps 44 between them that open when the seal assembly 18 is actuated and close as the sleeve 12 is returned to the run in position of FIG. 1. In other words the segments 28 and 30 are run in and retrieved in two distinct overlapping rows and on deployment go to the single row 32 configuration as the segments 30 due to opening gaps 42 fall in between segments 28 by landing on the facing ledge surfaces 32 and 36 of spaced apart segments 28.

Figure 3:
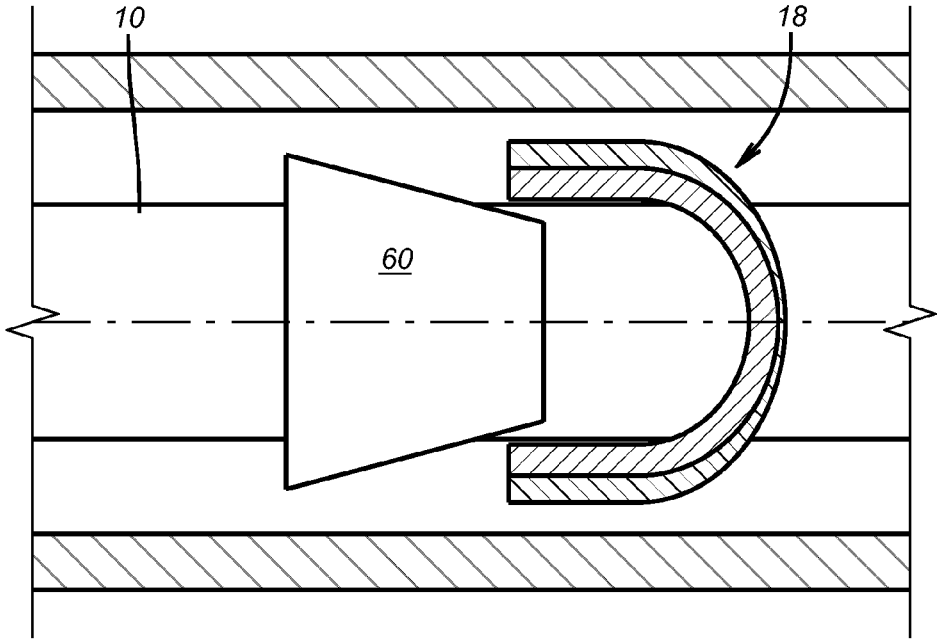
FIG. 3 shows a run in position with a swage spaced apart from the seal.
Figure 4:
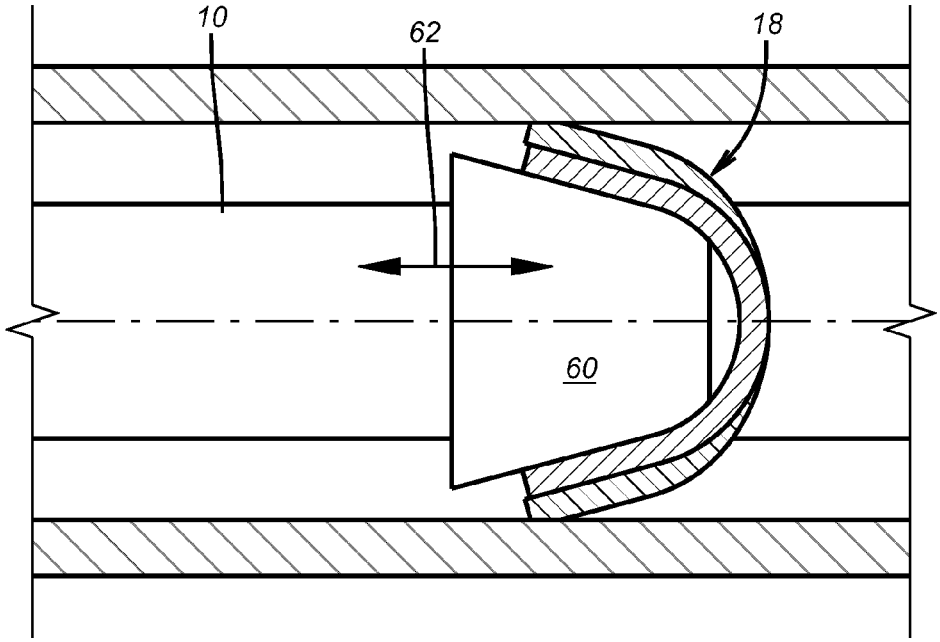
FIG. 4 is the view of FIG. 3 with the swage shifted to actuate the seal.

FIGS. 3 and 4 illustrate a different actuation technique. The seal assembly is the same as previously described but in this example is fabricated with an inward bias so that the FIG. 3 position can be sustained for run in without an external band spring or the like as illustrated for example in US Publication 2008/0251250. In FIG. 3 the tubular or mandrel 10 is not expanded internally. Rather an external swage 60 is positioned on the mandrel so that for example string manipulation can cause the swage 60 to advance relatively to the seal assembly and splay it out as shown in FIG. 4. One way this can be done is to have a telescoping section of the mandrel 10 that can combine with a j-slot so that the swage 60 can move bi-directionally to the FIG. 4 position and then selectively back to the FIG. 3 position. Drive mechanisms as previously described for the sleeve 12 are applicable to swage 60 movement in opposed directions and are schematically represented by arrow 62.

FIG. 5 illustrates using a seal assembly 18 to drive a string into a wellbore 80 using fluid pressure from above schematically represented as arrow 82.

Figure 8:
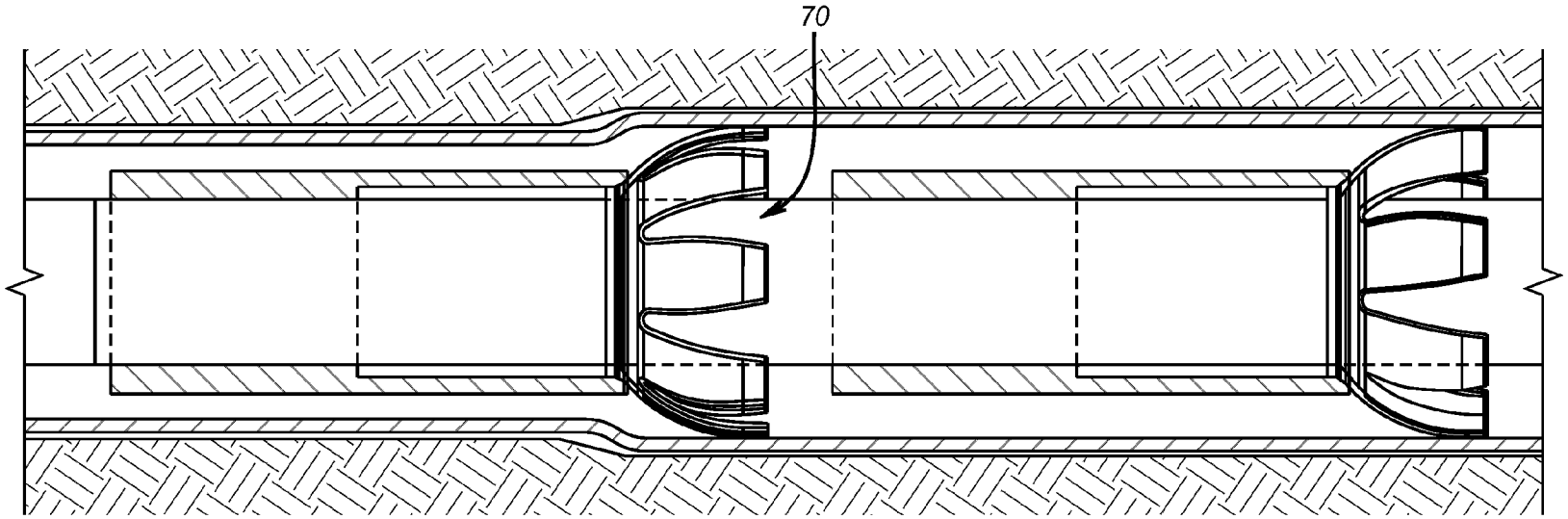
FIG. 8 is a tandem centralizer configuration showing alternate segments removed.

FIG. 8 shows gaps 70 such as by eliminating segments 28 or 30 and still allowing the assembly enough strength to function as a centralizer while allowing flow through the gaps 70. The structure is otherwise the same with the sleeve 12 in this case not needing the internal splines as in FIG. 11 due to the gaps 70 being deliberately placed there to allow flow in opposed directions.

Figure 9:
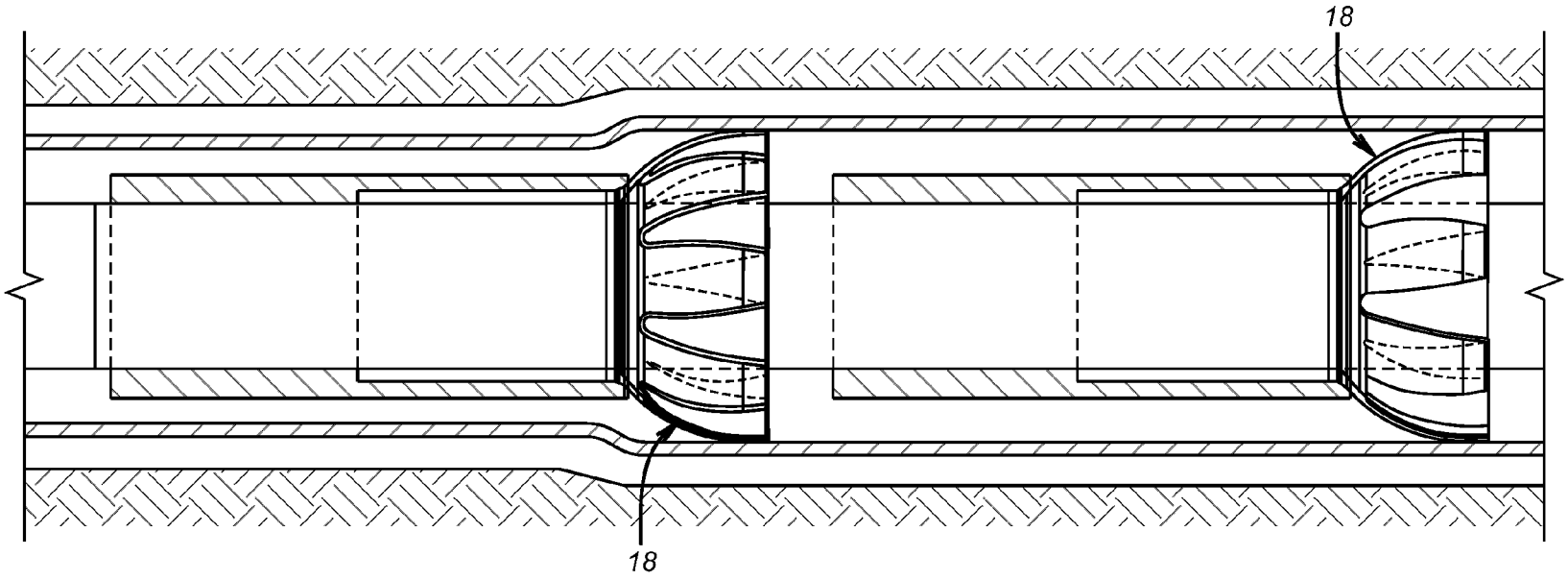
FIG. 9 shows seals oriented in the same direction for backup purposes.
Figure 10:
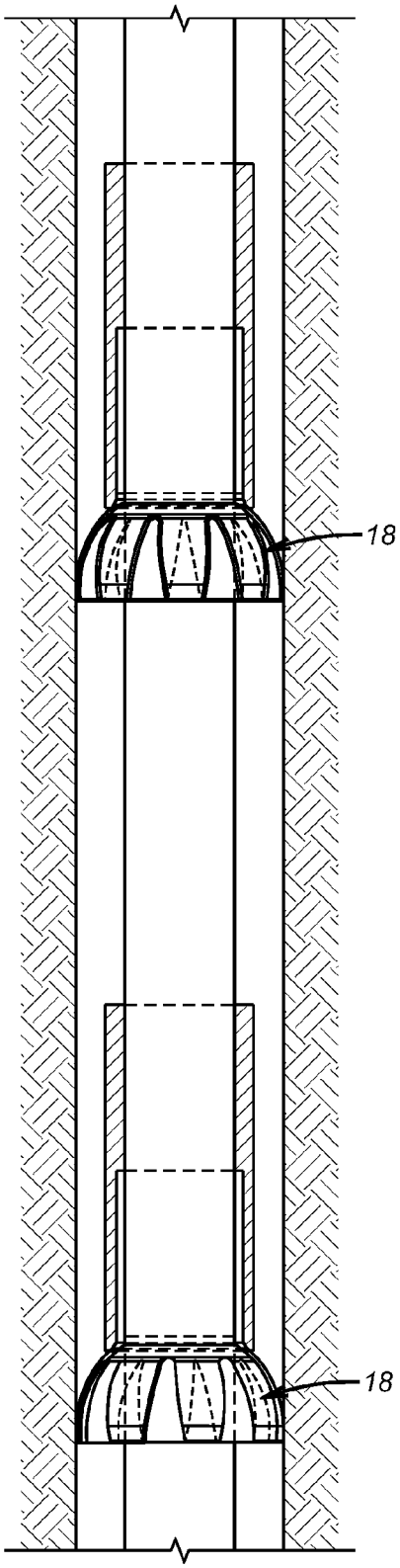
FIG. 10 shows a tandem seal arrangement in a vertical well to act as a backup blowout preventer.

FIG. 9 shows spaced seals oriented the same way and such configurations can be deployed in stage cementing processes. It should be noted that the seals 18 can have opposed orientations to isolate a zone between them such as for a straddle setting tool for setting packers or other hydraulically actuated tools. In another application in a vertical well as shown in FIG. 10 the stack of seals 18 can be used as a downhole blowout preventer where one seal 18 backs up another with both preventing flow from the formation coming uphole but allowing flow in the opposite direction provided from the surface.

Figure 11:
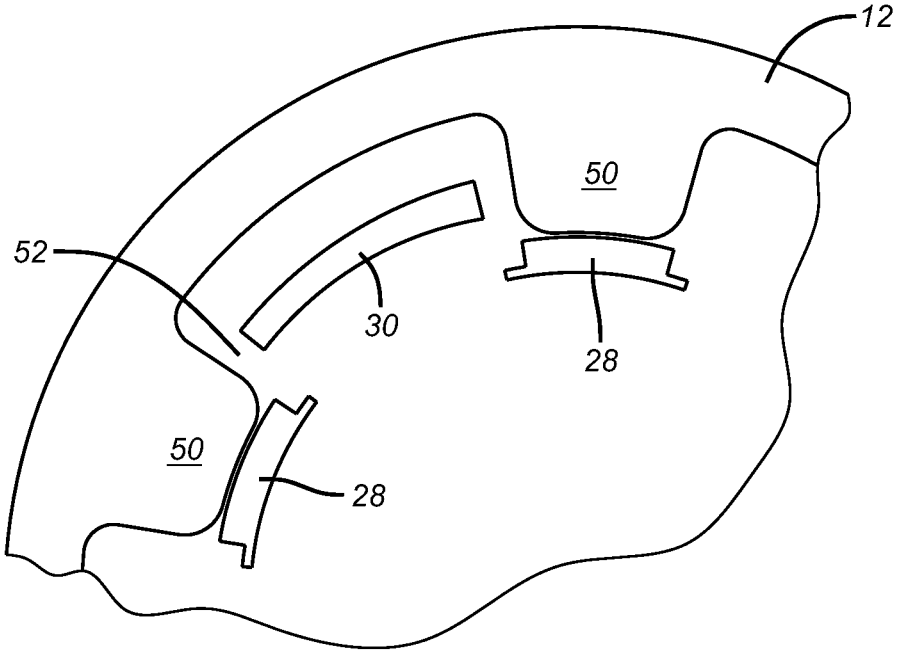
FIG. 11 is an end view similar to FIG. 6 with the release sleeve shifted back to collapse the seal assembly.

FIG. 11 shows the sleeve 12 in an end view so that the splines 50 can be seen that push on the segments 28 initially to move them radially inwardly as the sleeve 12 advances. The gaps 52 allow the segments 30 to remain radially behind the segments 28 as the sleeve 12 advances. The advancing of sleeve 12 back over the seal assembly has the effect of moving radially inwardly all the segments but allowing the segments 28 to be initially advance so that there is an edge offset so that the gaps 42 and 44 can close without binding as the seal assembly 18 returns to the FIG. 1 position for removal from a cased or open hole.

Those skilled in the art will appreciate that a structure that can function as a seal or as a centralizer is disclosed that can be held retracted with a shiftable sleeve that overlays it for run in and pulling out of the hole. The structure can be self energized to move out radially when the sleeve is withdrawn and alternatively can be pushed out by a swage into a sealing position. The general shape is a cup with an open end to prevent flow in the direction of going into the cup open end while allowing flow in the opposite direction. The cup can be formed of at least two layers that in the running in position radially overlay each other. In the deployed position gaps open between segments on the at least two layers such that the segments of an outer layer drop into alignment with segments from an inner adjacent layer so that the segments are at the same radial distance from the mandrel that passes through an opening in the seal assembly. The segments are shaped so that on a predetermined amount of radial movement their shapes conform to the shape of an opening gap between segments on another row so that alignment occurs circumferentially. Alternating segments have edge landing surfaces to align the segments from the adjacent layer that then get into place. The result is a single circumferential layer. The sleeve can have internal splines that push in the segments with edge supports first to allow gaps between segments to again be restored so that such gaps can get smaller as the assembly collapses to the run in condition. Leaving out alternative segments allows the structure to function as a centralizer while letting flow therethrough. In that instance the covering sleeve does not use the internal splines. When used as seals or centralizers the assemblies can be provided as redundant to each other with the open cup orientations identical or the orientations can be opposed for isolation and pressuring up between spaced seal assemblies. The segments and the base that connects them in any given layer or all the layers can be coated for durability and enhanced sealing engagement between the segments. A variety of applications are envisioned in vertical and horizontal wells. The sleeve can be fully retracted away from the segments and the base from which they extend or part way as desired.

The above description is illustrative of the preferred embodiment and many modifications may be made by those skilled in the art without departing from the invention whose scope is to be determined from the literal and equivalent scope of the claims below:

We claim:

1. An apparatus for support or sealing around a mandrel in a cased or open hole borehole defined by a borehole wall, comprising:

a mandrel;

at least one assembly of a plurality of segments extending from a base, said mandrel extending through said base;

a retainer for selective retention of said segments adjacent said mandrel for run in and subsequently releasing said segments to move against the borehole wall for use, said retainer retracts said segments after said use for removal of said mandrel, base and segments from the borehole, said segments defining an open end opposite said base during use.

2. An apparatus for support or sealing around a mandrel in a cased or open hole borehole defined by a borehole wall, comprising:

a mandrel;

at least one assembly of a plurality of segments extending from a base, said mandrel extending through said base;

a retainer for selective retention of said segments adjacent said mandrel for run in and removal from the borehole after use, said retainer releasing said segments to move against the borehole wall, said segments defining an open end opposite said base during use;

said retainer selectively is movable relative to said mandrel from a first position of overlying said segments to a second position adjacent said base to allow radial movement of said segments to the borehole wall; and said retainer movable back to said first position to retract said segments from the borehole wall.

3. The apparatus of claim 2, wherein:

said retainer retracts some of said segments before others of said segments.

4. The apparatus of claim 2, wherein:

said retainer comprises raised internal surfaces to retract some segments before other said segments.

5. An apparatus for support or sealing around a mandrel in a cased or open hole borehole defined by a borehole wall, comprising:

a mandrel.

at least one assembly of a plurality of segments extending from a base, said mandrel extending through said base;

a retainer for selective retention of said segments adjacent said mandrel for run in and selective retention during removal from the borehole after use, said retainer releasing said segments to move against the borehole wall, said segments defining an open end opposite said base during use;

alternating segments have edge ledges onto which other segments land when said retainer releases said segments.

6. An apparatus for support or sealing around a mandrel in a cased or open hole borehole defined by a borehole wall, comprising:

a mandrel.

at least one assembly of a plurality of segments extending from a base, said mandrel extending through said base;

a retainer for selective retention of said segments adjacent said mandrel for run in and selective retention during removal from the borehole after use, said retainer releasing said segments to move against the borehole wall, said segments defining an open end opposite said base during use;

said segments radially overlap into multiple rows when retained by said retainer and define a single row when released by the retainer.

7. An apparatus for support or sealing around a mandrel in a cased or open hole borehole defined by a borehole wall, comprising:

a mandrel;

at least one assembly of a plurality of segments extending from a base, said mandrel extending through said base;

a retainer for selective retention of said segments adjacent said mandrel for run in and selective retention during removal from the borehole after use, said retainer releasing said segments to move against the borehole wall, said segments defining an open end opposite said base during use;

said segments define varying gaps when released by said retainer and are shaped such that at a predetermined amount of radial segment movement, segments that previously overlapped circumferentially align in said gaps.

8. The apparatus of claim 7, wherein:

said segments are spaced apart when retained such that on release by said retainer the segments centralize said mandrel while allowing flow through said gaps.

9. An apparatus for support or sealing around a mandrel in a cased or open hole borehole defined by a borehole wall, comprising:

a mandrel;

at least one assembly of a plurality of segments extending from a base, said mandrel extending through said base;

a retainer for selective retention of said segments adjacent said mandrel for run in and selective retention during removal from the borehole after use, said retainer releasing said segments to move against the borehole wall, said segments defining an open end opposite said base during use;

said at least one assembly comprises multiple assemblies where the orientation of said open ends is aligned or opposed.

10. The apparatus of claim 1, wherein:

said retainer comprises a remotely actuated sleeve axially movable in opposed directions.

11. The apparatus of claim 1, wherein:

said segments move into a single row circumferentially using developed potential energy therein to seal against the borehole wall.

12. The apparatus of claim 1, wherein:

said retainer retracts some of said segments before others of said segments.

13. The apparatus of claim 2, wherein:

said retainer comprises raised internal surfaces to retract some segments before other said segments.

14. The apparatus of claim 13, wherein:

alternating segments have edge ledges onto which other segments land when said retainer releases said segments.

15. The apparatus of claim 14, wherein:

said segments radially overlap into multiple rows when retained by said retainer and define a single row when released by the retainer.

16. The apparatus of claim 15, wherein:

said segments define varying gaps when released by said retainer and are shaped such that at a predetermined amount of radial segment movement, segments that previously overlapped circumferentially align in said gaps.

17. The apparatus of claim 16, wherein:

said segments are spaced apart when retained such that on release by said retainer the segments centralize said mandrel while allowing flow through said gaps.

18. The apparatus of claim 16, wherein:

said at least one assembly comprises multiple assemblies where the orientation of said open ends is aligned or opposed.

19. The apparatus of claim 18, wherein:

said retainer comprises a remotely actuated sleeve axially movable in opposed directions.

20. The apparatus of claim 15, wherein:

said segments move into a single row circumferentially using developed potential energy therein to seal against the borehole wall.

* * * * *